US006371366B1

(12) United States Patent
Edgerton et al.

(10) Patent No.: US 6,371,366 B1
(45) Date of Patent: Apr. 16, 2002

(54) COLLECTIBLES DISPLAY BOX

(76) Inventors: Kevin Edgerton; Tracie Malesa, both of 9406 Davenport St., Omaha, NE (US) 68114

( * ) Notice: Subject to any disclaimer, the term of this patent is extended or adjusted under 35 U.S.C. 154(b) by 0 days.

(21) Appl. No.: 09/630,773

(22) Filed: Aug. 2, 2000

(51) Int. Cl.[7] ..... B65D 25/54

(52) U.S. Cl. ..... 229/162; 206/756; 206/765; 206/772

(58) Field of Search ..... 206/459.5, 756, 206/759, 760, 765, 767, 769, 772; 229/162, 151, 152

(56) References Cited

U.S. PATENT DOCUMENTS 1,150,852 A * 8/1915 Davison ..... 229/162 X
1,152,240 A * 8/1915 Todd ..... 229/162 X
1,455,792 A * 5/1923 Kessler ..... 229/162 X
1,558,305 A * 10/1925 Snape ..... 229/162 X
2,219,183 A * 10/1940 Harnett et al. ..... 206/777
2,643,811 A * 6/1953 Bolding ..... 229/120.12
3,799,424 A * 3/1974 Mayea ..... 229/162 X
4,320,830 A * 3/1982 Roccaforte ..... 229/760 X
4,354,596 A * 10/1982 Lavery ..... 229/152
4,735,356 A * 4/1988 Engel ..... 229/103
4,925,087 A * 5/1990 Ostrander ..... 229/162 X

* cited by examiner

*Primary Examiner*—Stephen P. Garbe
*Assistant Examiner*—Tri M. Mai
(74) *Attorney, Agent, or Firm*—Adam H. Jacobs

(57) ABSTRACT

A collectable box includes a front wall, at least two side walls and top and bottom closure flaps which form the gift box. A generally transparent window is mounted in the front wall, and a window covering flap is removably mounted on the box which is operative to cover the window and generally prevent viewing of the contents of the box. Finally, a guide device is mounted on the inner face of the front wall generally adjacent the window, the guide means operative to releasably secure the window covering flap adjacent said window thereby preventing viewing of the contents of the box through the window.

4 Claims, 4 Drawing Sheets

COLLECTIBLES DISPLAY BOX

BACKGROUND OF THE INVENTION

1. Technical Field

The present invention relates generally to packaging for gifts and, more particularly to a collectible display box which includes a transparent window formed in one of the walls of the box to permit view of the product within the box and a window covering flap which, when in an open position, permits viewing of the goods within the box and, when in a closed position, internally covers the display window to prevent viewing of the goods within the box.

2. Description of the Prior Art

There are presently used in the packaging industry a virtually unlimited number of cardboard box sizes and shapes which are used to package goods. One rapidly growing segment of the packaging industry is in the gift or collectible box segment in which a variety of highly attractive packaging solutions have been developed. It has long been known that to encourage the purchase of a good, the consumer must be able to see the good through the packaging of the good. Various types of boxes have been invented to fulfill this need including those disclosed in Bolding, U.S. Pat. No. 2,643,811 and Palmer, U.S. Pat. No. 3,186,622. Each of these boxes disclose a cardboard box having a transparent window surface which permits the viewing of the good held within the box, thus encouraging purchase of the good. It is well known in the prior art to provide such packaging which exhibits the contents of the packaging in a pleasing and aesthetic way.

However, each of the display boxes found in the prior art have one inherent defect in common, that being that the packaging itself cannot be used in the giving of the gift without first either wrapping the package to disguise the contents or somehow covering up the transparent window which permits the viewing of the good stored within the packaging. There is therefore a need for a gift packaging box which can be used "as is" to give the good held there within to the recipient, without the recipient knowing the contents of the packaging prior to opening the package.

Another problem encountered in using the packaging found in the prior art is that the packaging does not include a space where packaging accessories such as bows, ribbons, etc. can be stored prior to their use to enhance the packaging appearance. There is therefor a need for a gift packaging which incorporates storage space for such packaging enhancement devices.

The majority of boxes found in the prior art which incorporate transparent windows do not make allowances for means to cover up the window when the contents of the packaging are not to be seen. In those that do, a box section is included to be positioned over the window in order to prevent the viewing of the contents. These types of boxes are inherently defective, however, in that the flap may be easily moved from the window surface if it is not secured by additional securement means, and, therefore, the intended purpose of preventing viewing of the packaging contents is not achieved. There is therefore a need a gift display box which incorporates a covering flap which can be releasably secured adjacent the transparent window by guide means such as slots or channels which the flap can fit into.

Therefore, an object of the present invention is to provide an improved collectible display box.

Another object of the present invention is to provide a collectible display box which includes a transparent window and a box flap operative to cover the window from the inside of the box when in a closed position and to be folded away from the transparent window when the viewing of the contents of the box is desired.

Another object of the present invention is to provide a releasable flap securement means such as guide channels or slots into which the edges of the flap can be fit to secure the flap adjacent the transparent window to prevent accidental viewing of the packaging.

Another object of the present invention is to provide a collectible display box which incorporates an additional chamber for storage of packaging appearance enhancement devices such as ribbons, bows, and other such devices.

Finally, an object of the present invention is to provide a collectible display box which is relatively simple and inexpensive to manufacture and is safe and effective in use.

SUMMARY OF THE INVENTION

The present invention provides a collectable gift box which includes a front wall, at least two side walls and top and bottom closure flaps which form the gift box. A generally transparent window is mounted in the front wall, and a window covering flap is removably mounted on an inner face of the front wall which is operative to cover the window and generally prevent viewing of the contents of the box. Finally, a guide device is mounted on the inner face of the front wall generally adjacent the window, the guide means operative to releasably secure the window covering flap adjacent said window thereby preventing viewing of the contents of the box through the window.

The present invention also provides a lower compartment for storage of bows, ribbons or other package appearance enhancement devices which can be opened to allow the purchaser to use the bows on the package. The lower compartment can then be reclosed to place the box in its original condition.

The present invention thus provides a substantial improvement over those devices found in the prior art. For example, the window covering flap can be used to prevent the viewing of the contents of the box by the person receiving the gift box. Furthermore, because the guide device releasably secures the window covering flap against the inner side of the window, accidental viewing of the contents of the gift box is prevented. Also, the inclusion of the lower compartment with bows and ribbons therein means that a purchaser of the gift box of the present invention need not purchase additional package appearance enhancement devices to "dress up" the package. Finally, because the box is integrally formed in the preferred embodiment, the use of the window covering flap is greatly facilitated. It is therefore clear that the present invention provides a gift box which represents a substantial improvement over those devices found in the prior art.

DESCRIPTION OF THE PREFERRED EMBODIMENT

Figure 2:
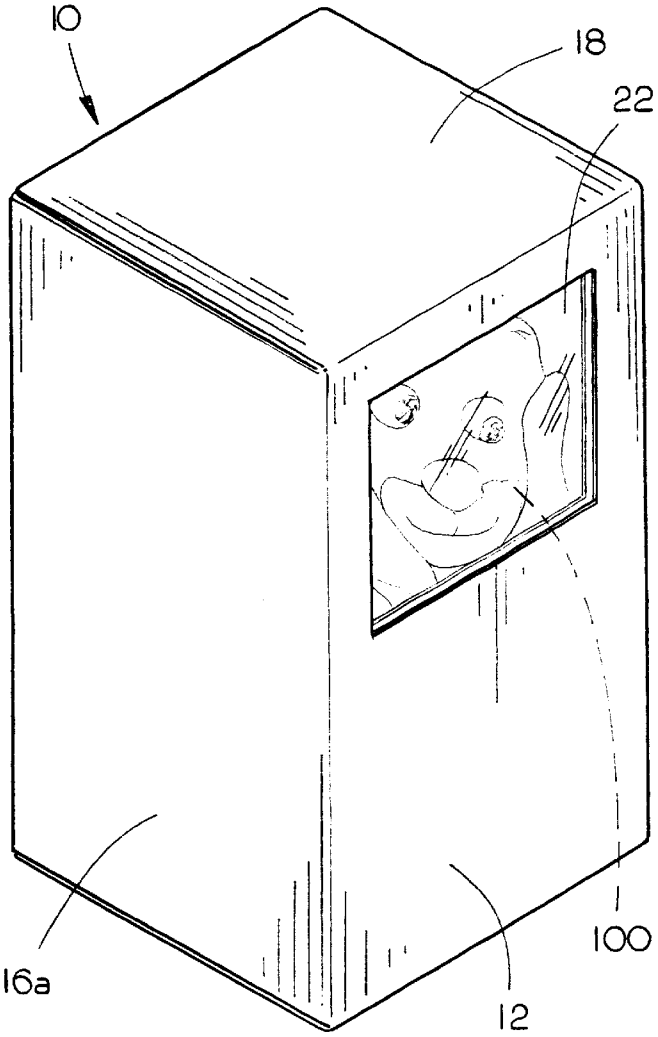
FIGS. 1 and 2 are prospective views of the collectible display box of the present invention, FIG. 1 showing the window covering flap in closed position and FIG. 2 showing window covering flap in opened position.

The collectibles displace box 10 of the present invention is shown best in FIGS. 1–6 as including a front wall 12 rear wall 14, side walls 16*a* and 16*b*, a top flap 18 and bottom flap 20, which combine to form a generally rectangular box as shown. It is to be understood that although the present invention as shown in FIGS. 1–6 as including the four walls and top and bottom flaps, it is well within the scope of this disclosure to include additional walls to produce a box having a different shape or to modify the size of the box to package variously sized items. Therefore, the precise shape and dimensions of the collectible display box 10 of the present invention are not critical to the present invention so long as the characteristics of the invention are maintained. Also, it is preferred that the box be constructed of treated strengthened paper or cardboard for durability and ease of disposal.

Figure 1:
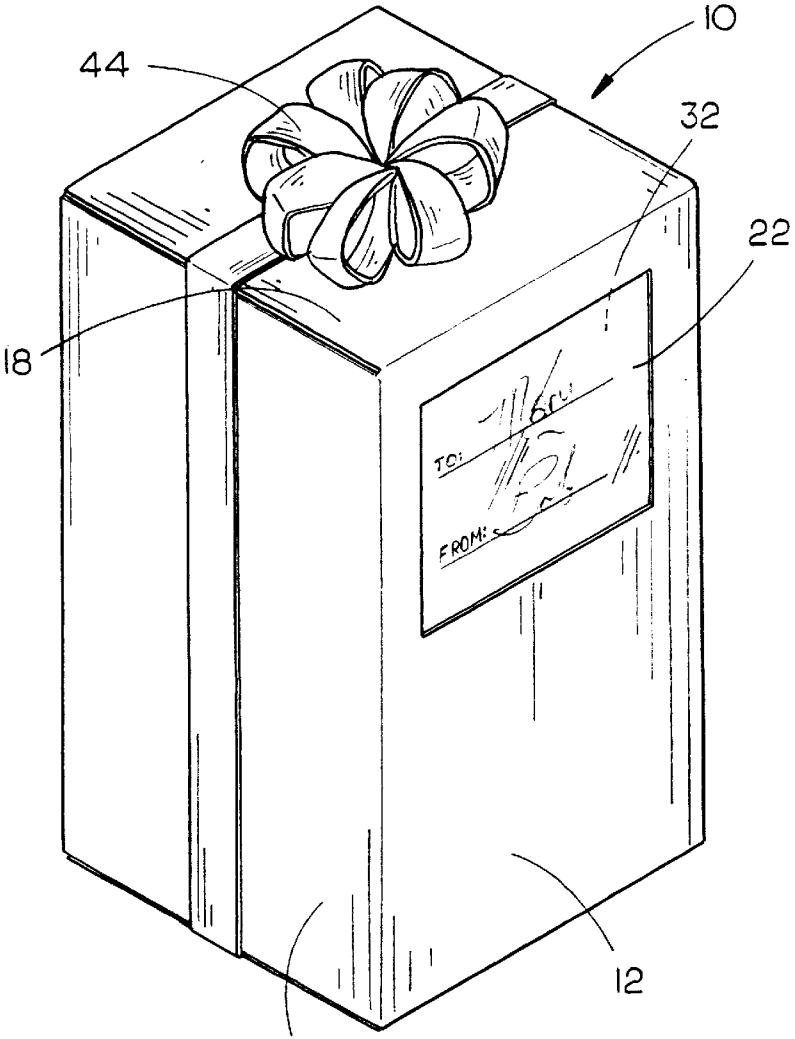
Figure 4:
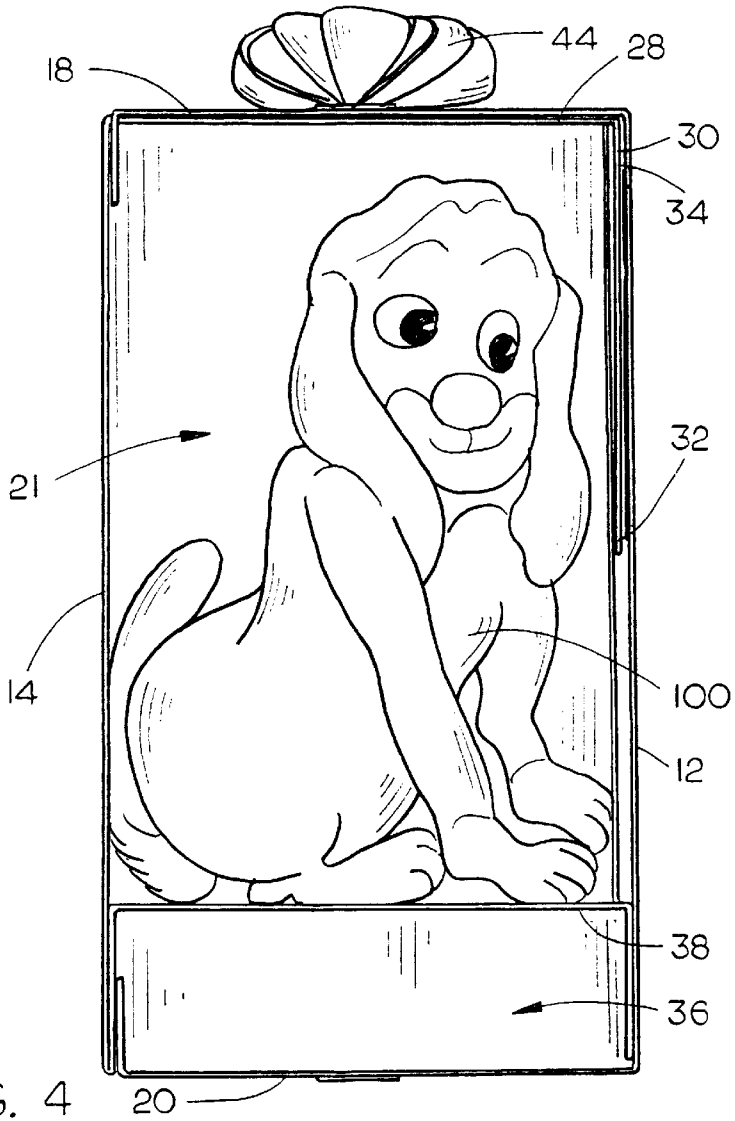
FIGS. 3 and 4 are detail side elevational views of box of the present invention showing the window covering flap in open and closed position respectively.

As shown best in FIGS. 1 and 2, front wall 12 further includes a transparent window 22 which permits viewing of the collectible 100 held within the upper compartment 21 of box 10 when the window 22 is not covered. Again, the exact size and shape of the transparent display window 22 is not critical to the present invention so long as the contents of the box 10 may be viewed through the window 22, although in the embodiment shown in FIGS. 1 and 2, window 22 would have dimensions of approximately 2" to 3" square. It is preferred that the window be constructed of plastic film, although numerous types of materials may be used as are well-known in the prior art.

Figure 3:
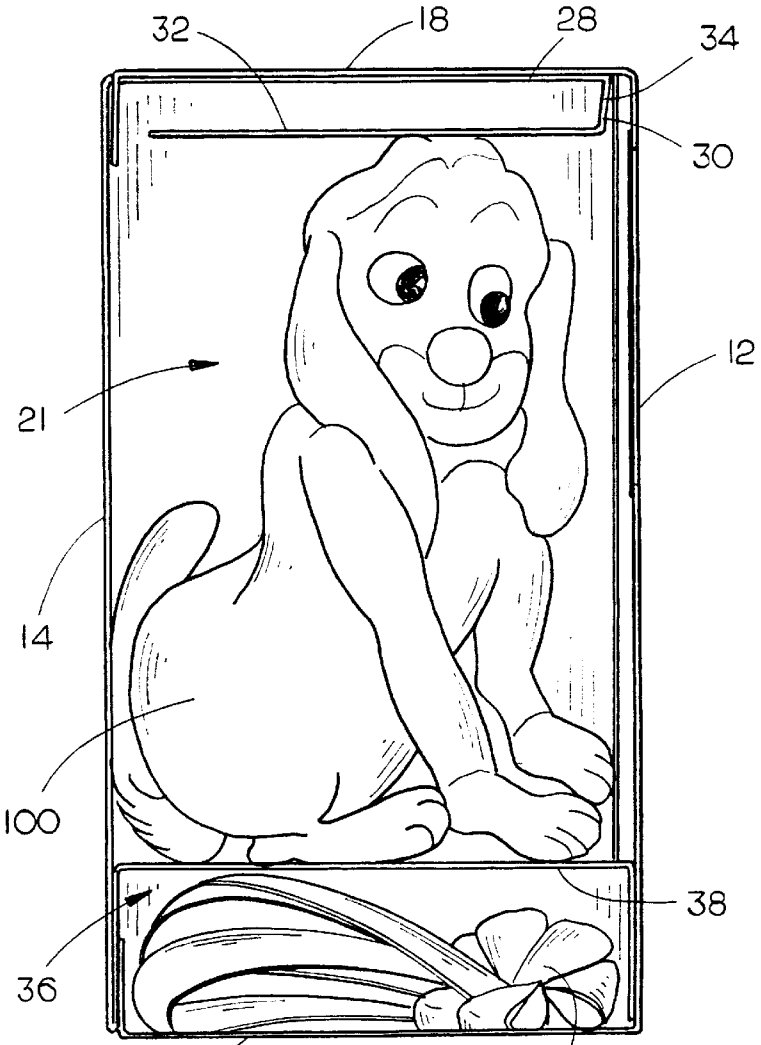
Figure 5:
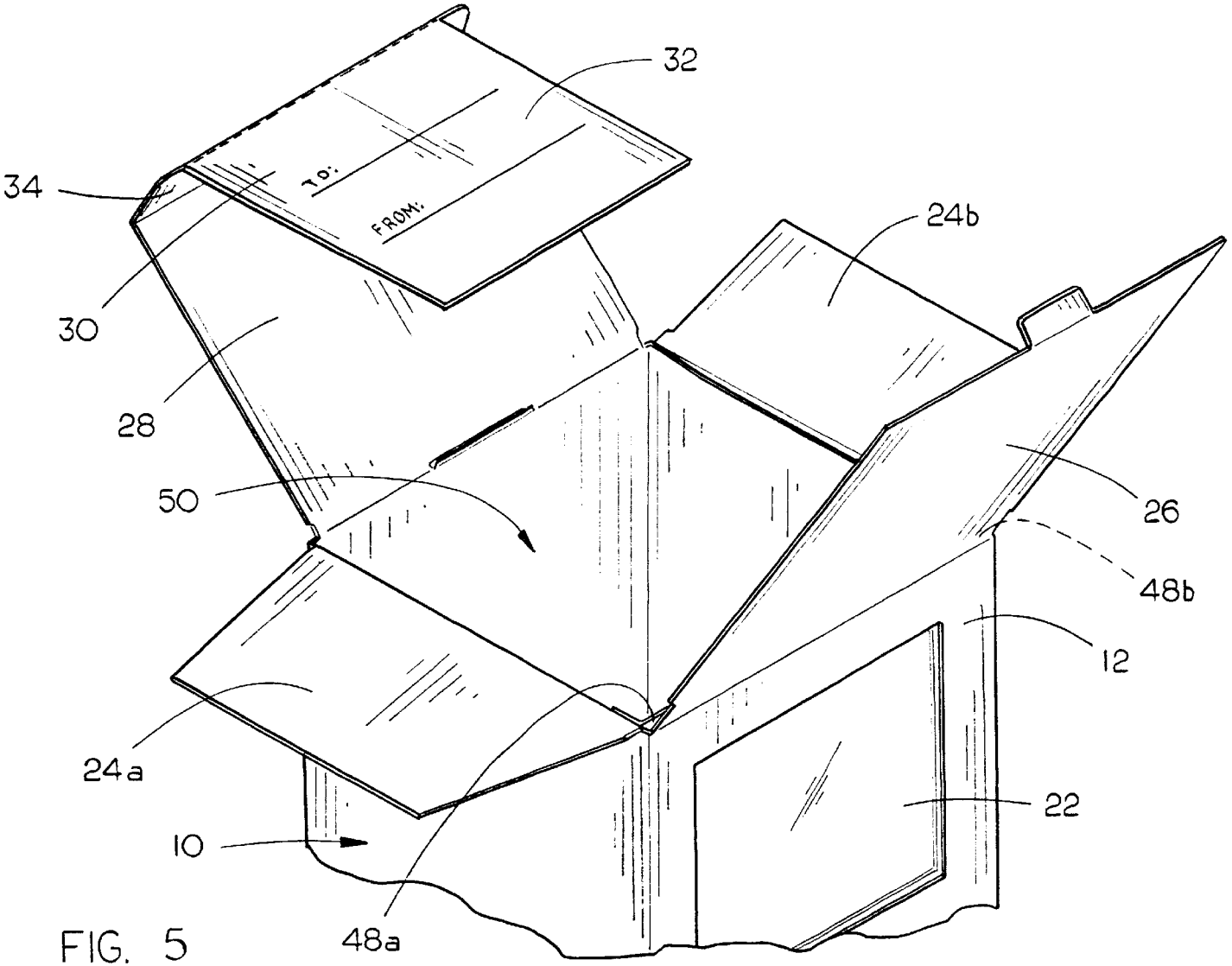
FIG. 5 is a partial detail perspective view of the upper end of the collectible display box of the present invention.
Figure 6:
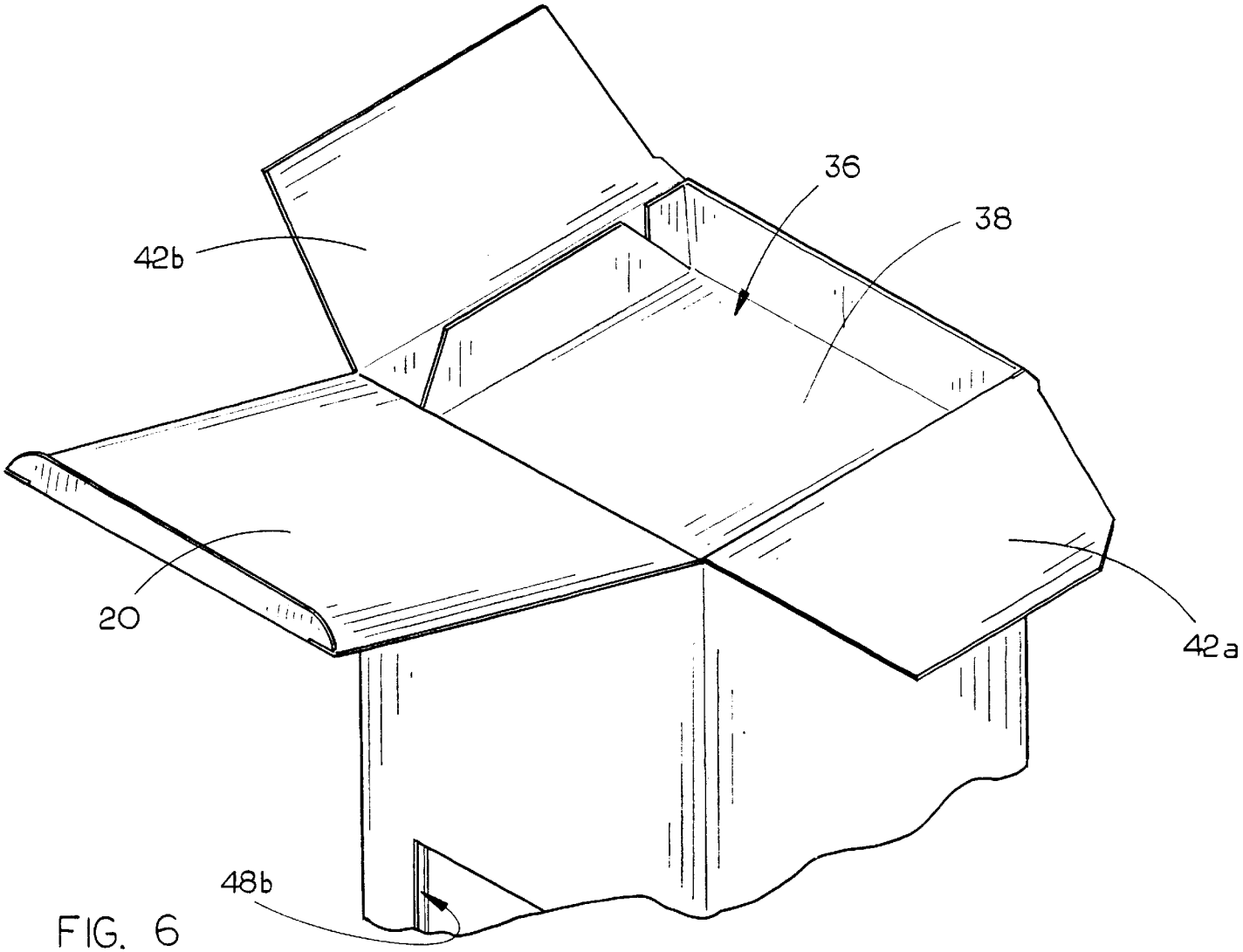
FIG. 6 is a partial detail prospective view of the lower end of the collectible display box of the present invention.

The preferred embodiment shown in FIGS. 1 and 2 further includes a pair of trapezoidal top flaps 24*a* and 24*b*, which are hingedly connected to the upper edges of side walls 16*a* and 16*b* respectively, a front top flap 26 hingedly connected to the upper edge of front wall 12, and a rear top flap 28 hingedly connected to the upper edge of rear wall 14. As shown best in FIG. 3, when the top opening 50 of box 10 is closed by the folding of trapezoidal top flaps 24*a* and 24*b*, top front flap 26 and rear top flap 28, the collectible toy 100 within box 10 can be viewed through transparent display window 22. This is because depending flap section 30 of rear top flap 28 is folded rearwardly and upwardly to be positioned above the collectible toy 100, as shown in FIG. 3, thus permitting viewing of collectible toy 100 through transparent display window 22. In the preferred embodiment, the depending flap section 30 of rear top flap 28 would include two subsections, an upper box closing tab 34 and a lower window covering subsection 32. It is preferred that box closing tab 34 be hingedly connected to the forward edge of rear top flap 28 and that lower window covering subsection 32 be connected to box closing tab 34 along a perforation permitting window covering subsection 32 to be separated from box closing tab 34.

The base of box 10 further includes a lower compartment 36 which is formed by the inclusion of dividing wall 38 which is secured between the upper compartment 21 and lower compartment 36. Access to the lower compartment 36 is provided by the bottom flap 20 and side flaps 42*a* and 42*b* which, when folded, secure and close the lower compartment 36. The lower compartment 36 is designed to retain and restore package appearance enhancement accessories such as bows, ribbons or other such items which may be applied by the purchaser of the collectible display box 10 and to enhance the appearance of the package as the individual sees fit. Once the bows and/or ribbons 44 are removed from the lower compartment 36, the lower compartment 36 may be resealed thus placing box 10 in its original unopened condition.

The particular inventive features of the present invention may best be described in connection with the sequence involved in purchasing and preparing the collectible for distribution to a third party. After an individual has purchased the box 10 including collectible toy 100, the individual would open the front and rear top flaps 26 and 28, thus permitting access to the window covering section 32 of depending flap section 30. The individual would then write the appropriate information on the "To" and "From" lines printed on the depending flap section 30 and replace the flaps in the box with one significant exception. The window covering section 32 of depending flap section 30 is designed to fit into guide slots 48*a* and 48*b* which, in the preferred embodiment, are mounted on the inner surface of front wall 12 and are positioned on opposite sides of and adjacent to transparent display window 22. As the window covering section 32 is slid into guide slots 48*a* and 48*b*, the window covering section 32 is secured against the interior surface of the transparent display window 22 thus preventing viewing through the window and thus preventing viewing of the collectible toy 100 stored within collectible display box 10. The size and shape of window covering section 32 is designed to completely cover the transparent display window 22 and thereby prevent viewing of the contents of the box 10. Additionally, the guide slots 48*a* and 48*b* secure the window covering section 32 against display window 22 thus preventing shifting of window covering section 32 and permitting accidental glimpses of the contents of box 10. Furthermore, the "To" and "From" lines on the window covering section 32 may be easily viewed through the transparent display window 22 so that the intended gift recipient will know that the gift is intended for him or her. Finally, the box closing tab subsection 34 of depending flap section 30 acts to frictionally secure the rear top flap 28 in a closed position.

The individual would then remove the bows/ribbons 44 from lower compartment 36 and place them in appropriate positions on the outer surface of collectible display box 10, thus enhancing the overall appearance of the box 10 and promoting festive connotations due to the appearance of the box 10. As it is preferred that the outer surface of the box 10 be imprinted with designs in the manner of wrapping paper, the need for the box 10 to be wrapped separately is eliminated and the gift-giving individual need not purchase additional supplies to insure that the recipient not see the gift prior to opening the package.

Of course, it is to be understood that numerous modifications, additions and substitutions may be made to the collectible display box 10 of the present invention which fall within the intended broad scope of the appended claims. For example, the size, shape and dimensions of the collectible display box 10 of the present invention may be modified and/or changed so long as the intended functioning of the invention is not disrupted. Furthermore, it may be advantageous to provide transparent windows in additional places on the box which would necessitate the addition of window covering sections connected to additional flaps depending from the top edges of the walls of the box. Such a modification is understood to be within the purview of this disclosure. Also, although the window covering device has been described as a flap positioned on the inside of the box, it should be noted that numerous types of window coverings could be substituted for the previously-described flap which fall within the intended broad scope of the appended claims. Finally, although the construction material of the box of the present invention has been described as being card stock or cardboard, it is to be understood that numerous other types of materials may be substituted for the described materials which fall within the intended broad scope of the appended claims.

There has therefore been shown and described a collectible display box which accomplishes at least all of its intended objectives.

We claim:

1. A collectable display and gift box comprising:

a front wall having an inner face, at least two side walls, a rear wall and top and bottom closure means thereby forming said gift box;

said top closure means including a front top flap hingedly connected to an upper edge of said front wall, and a rear top flap hingedly connected to an upper edge of said rear wall;

a generally transparent window mounted in said front wall;

window covering means mounted on said box operative to cover said window and generally prevent viewing of contents of said box, said window covering means including a depending flap section connected to and pivotably extending from said rear top flap, said depending flap section operative to be folded rearwardly and upwardly to an upper position in which contents of said gift box are viewable through said window, and operable to be folded downwards to a lower position adjacent said front wall wherein said depending flap section substantially covers said window thereby generally prevent viewing of contents of said box; and guide means mounted on at least one of said front wall and said side walls adjacent said inner face of said front wall generally adjacent said window, said guide means for releasably securing said depending flap section of said window covering means adjacent said window.

2. The collectable box of claim 1 further comprising a dividing wall fixed within said box thereby dividing said box into upper and lower compartments, each separately accessible via said top and bottom closure means, respectively.

3. The collectable box of claim 1 comprising two side wall and further comprising a rear wall interposed between said side walls whereby said gift box is generally rectangular in shape.

4. The collectable box of claim 1 wherein said guide means comprise guide slots mounted on at least one of said front wall and said side walls adjacent said inner face of said front wall on opposite sides of and generally adjacent to said window whereby upon said depending flap section being slid into said guide slots, said depending flap section is releasably secured adjacent said window thus preventing viewing of box contents through said window.

* * * * *